US006634995B1

(12) United States Patent
Reed

(10) Patent No.: US 6,634,995 B1
(45) Date of Patent: Oct. 21, 2003

(54) MANUALLY OPERATED STRETCHING APPARATUS

(75) Inventor: Michael S. Reed, Scottsdale, AZ (US)

(73) Assignee: Stretch Power LLC, Scottsdale, AZ (US)

( * ) Notice: Subject to any disclaimer, the term of this patent is extended or adjusted under 35 U.S.C. 154(b) by 315 days.

(21) Appl. No.: 09/894,951

(22) Filed: Jun. 28, 2001

(51) Int. Cl.[7] ..... A63B 21/00

(52) U.S. Cl. ..... 482/92; 482/907; 482/66; 482/132

(58) Field of Search ..... 482/92, 66, 132, 482/907, 68, 91, 121, 122, 125, 126, 127, 129, 148

(56) References Cited

U.S. PATENT DOCUMENTS 5,067,709 A * 11/1991 Christianson
5,108,090 A 4/1992 Reed
5,421,801 A 6/1995 Davies
5,674,163 A * 10/1997 Sennett
5,863,280 A * 1/1999 Wang
5,876,310 A 3/1999 Mackey
5,938,573 A 8/1999 Davies
6,210,348 B1 4/2001 Reed
6,368,259 B1 * 4/2002 Liao
6,544,152 B2 * 4/2003 Rosati

* cited by examiner

*Primary Examiner*—Jerome W. Donnelly
(74) *Attorney, Agent, or Firm*—LaValle D. Ptak

(57) ABSTRACT

An exercise device for stretching the lower back and leg muscles of a user includes a flexible footrest and a handle device. The handle device is designed to be grasped by the hands of a user and the cable is attached, at one end, to a footrest or fixed location. The other end of the cable is engaged by a rotatable member in the handle device; and a pawl and ratchet mechanism in the handle device rotates the rotatable member to draw the cable member into the device. A reciprocating lever member is operated by the user, grasping the handle member to effect incremental stepwise rotation of the rotatable member through the pawl and ratchet mechanism.

17 Claims, 8 Drawing Sheets

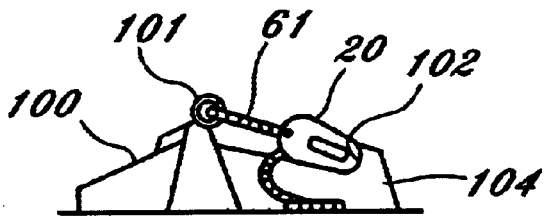
FIG. 14
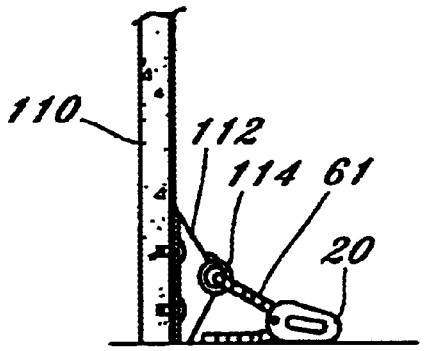
FIG. 18
FIG. 15
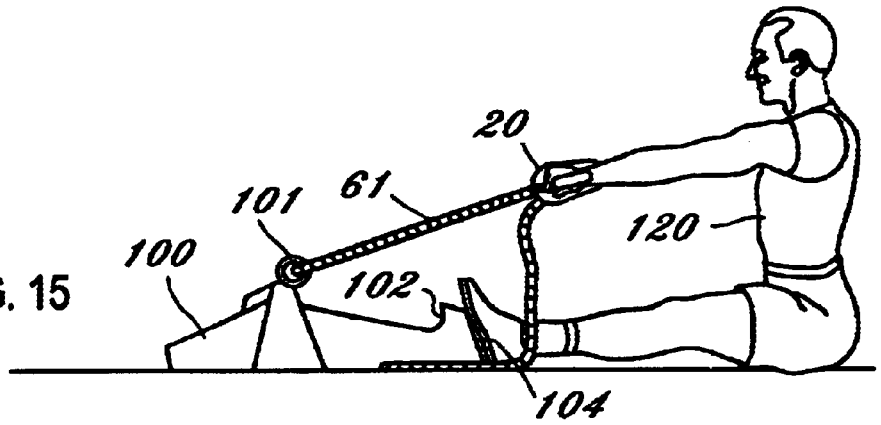
FIG. 16
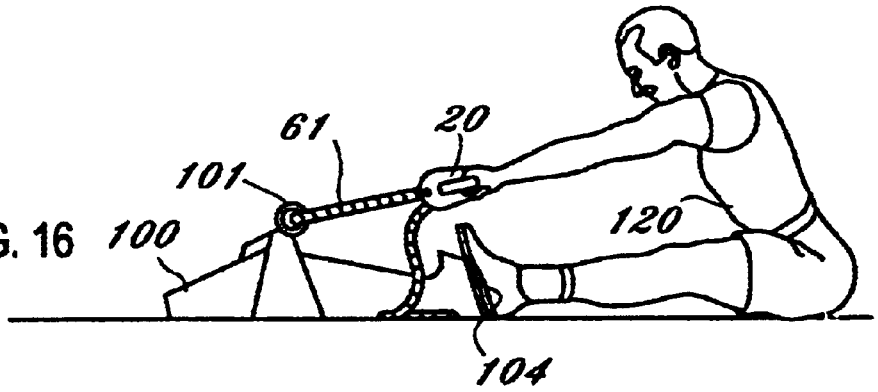
FIG. 17
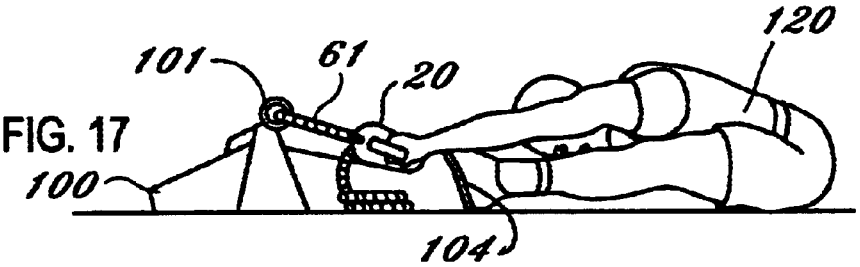

MANUALLY OPERATED STRETCHING APPARATUS

BACKGROUND

Exercise equipment has been designed for developing and maintaining physical fitness through a variety of exercises. Such equipment includes weight lifting machines, rowing machines, stair climbing machines, treadmills, and the like. Such machines, and most exercise regimens, are designed to improve the cardiovascular condition of the persons undertaking the exercise, and to provide muscle building and muscle toning. Fitness centers and home exercise equipment for accomplishing these purposes are in widespread use.

Although muscle building and muscle conditioning are important in developing and maintaining physical fitness, another part of the physical fitness story is developing body flexibility. Simply stated, a flexible body works better. Good posture, decreased stress, relief of muscular and joint pain, substantially improved physical and athletic ability and an enhanced sense of well being all come with improved flexibility. On the other hand, inflexibility, particularly in the lower back and hamstrings, causes low back and hamstring pain and injury.

A large percentage of the adult population in the United States suffers from lower back pain; and improving back flexibility can reduce or eliminate this type of pain. Although the benefits of such flexibility are important and obvious, achieving such flexibility has not been a simple task.

Inactivity and certain exercises, such as bicycle riding and running, cause the hamstring muscles to contract or shorten. Contracting the hamstring muscles then causes the pelvis to become unstable. This in turn tends to throw the spine out of alignment, constricting and pinching nerves, including the sciatica, which can cause moderate to severe pain from the lower back through the upper leg. It has been found that stretching before and after exercise reduces or eliminates the risk of injury from fitness workouts or athletic performance.

To properly stretch, the targeted muscles must be in a relaxed or passive state. Solo stretching the hamstring and other muscle groups creates an inherent conflict of self-generated stretching force interfering with the passive state muscles. While dynamic or ballistic stretching is an option, it is less effective, and it invites injury. Partner or training-assisted stretching also presents problems. Most obviously, another person is required each time the stretching exercise sequence is undertaken. Beyond this, however, it is difficult, even with a trainer, to produce consistent stretching tension.

A device for stretching the back and hamstring muscles of a user without requiring a partner or trainer is disclosed in the U.S. Pat. to Reed No. 5,108,090. This patent is directed to a power stretching device where the user is seated with legs extended. A leg immobilizing unit is provided; and an adjustable extension portion is attached pivotally to a reciprocating telescoping unit. The telescoping unit has hand grips at its upper end for engagement with the hands of the person using the device. A motor controls the reciprocating movement of the telescoping unit to cause it to move toward and away from the person using the device. Consequently, as the handgrips move away from the user toward the pivot, the user is pulled forward into a bending position to effect the desired stretching of the back and leg muscles. Although the device of the Reed Pat. No. 5,108,090 is effective for providing back stretching exercise, the mechanical parts are somewhat complex; and the overall device is relatively large.

Another approach for effecting the stretching of back and hamstring muscles is disclosed in the U.S. Pat. to Reed No. 6,210,348. The device of this patent is directed to an exercise device having a handle member designed to be grasped by the hands of a user. One end of a flexible cable is attached to a fixed position device; and the other end is attached to a rotatable reel in the handle member, which also carries apparatus coupled with the reel for rotating the reel to wind the cable while the handle member is grasped by the hands of a user. In some specific implementations of the device disclosed in the Reed Pat. No. 6,210,348, the rotatable reel is driven by an electric motor mounted within the handle member; and a switch is provided for turning on the motor to rotate the reel at a uniform speed to wind the cable.

It is desirable to provide an improved, hand-held mechanically operated stretching device.

SUMMARY OF THE INVENTION:

It is an object of this invention to provide an improved exercise device.

It is another object of this invention to provide an improved hand-held exercise device.

It is an additional object of this invention to provide an improved compact, easy to use, manually operated stretching apparatus.

It is a further object of this invention to provide an improved manually operated mechanical device for stretching the lower back and hamstring muscle groups.

In accordance with a preferred embodiment of the invention, an exercise device designed to stretch the back and leg muscles of a user includes a handle body having a handle member grasped by the hands of a user. A fixed position member is provided adjacent the location where the device is to be used. A flexible cable is secured at a first end to the fixed position member; and it is engaged by a rotatable member in the handle body. A manually operated pawl and ratchet mechanism in the handle body is used to rotate the rotatable member to draw the cable into the handle device through the operation of a reciprocating lever member coupled with the pawl and ratchet mechanism. Operation by a user reciprocating the handle member effects incremental stepwise rotation of the rotatable member through the pawl and ratchet mechanism to pull the flexible cable into the handle body.

BRIEF DESCRIPTION OF THE DRAWINGS

FIG. 14 is a diagrammatic illustration of a preferred embodiment of the invention in its storage position;

FIGS. 15, 16 and 17 illustrate different positions of a user operating the embodiment of the invention disclosed in FIGS. 1 through 14; and FIG. 18 is a diagrammatic illustration of a variation of a feature of the invention as an alternative to the one shown in FIG. 14.

DETAILED DESCRIPTION

Reference now should be made to the drawings, in which the same or similar reference numbers are used throughout the different figures to designate the same components. Initially, reference should be made to FIGS. 1, 2 and 3; although portions of the mechanism shown in these figures are also illustrated in various ones of the other figures in greater detail. The stretching apparatus of a preferred embodiment of the invention is housed within a handle body including a housing or housing device 20, which has a hollow interior.

Figure 1:
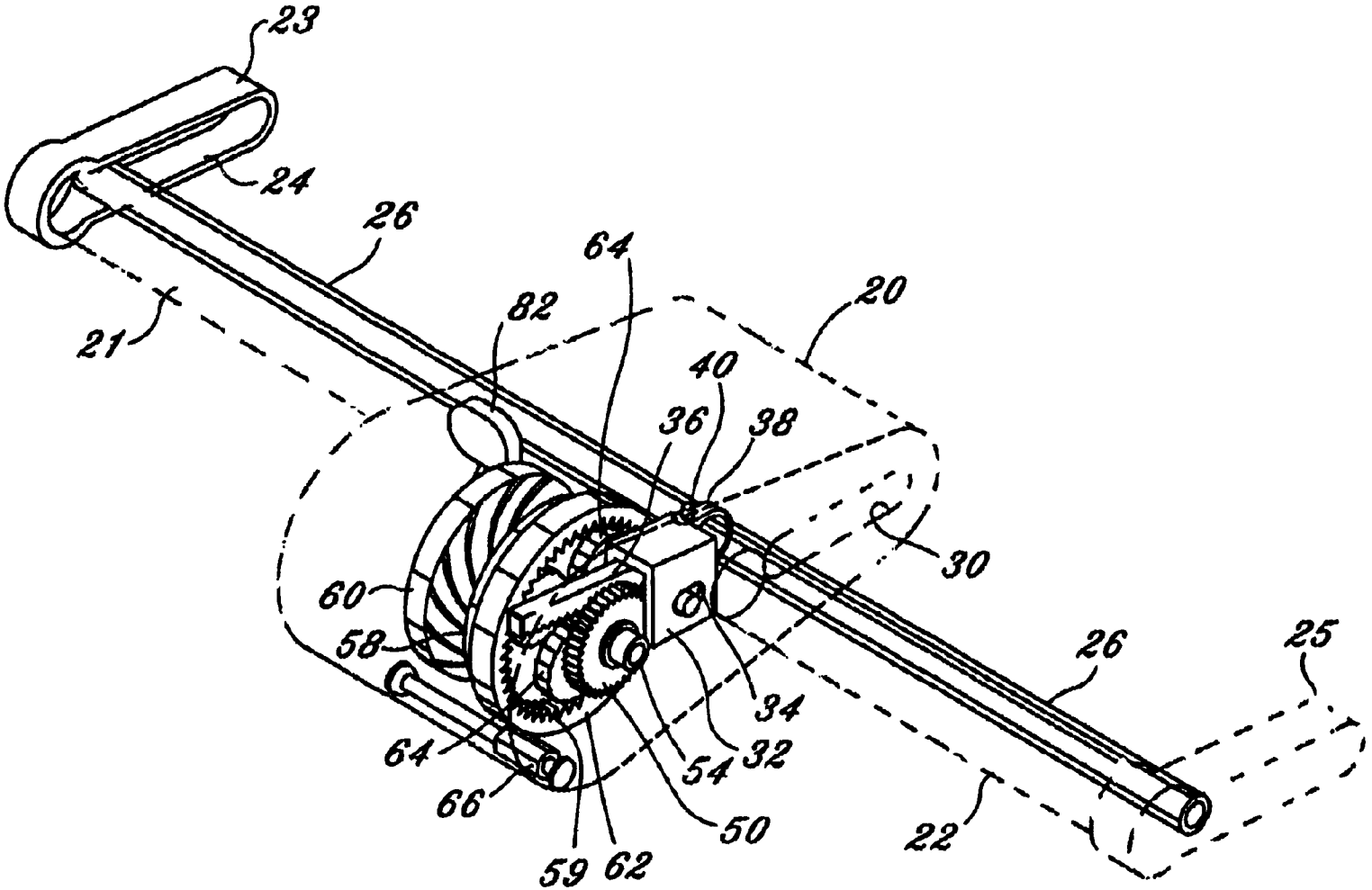
FIG. 1 is a front perspective view of a portion of the operating mechanism of a preferred embodiment of the invention.
Figure 2:
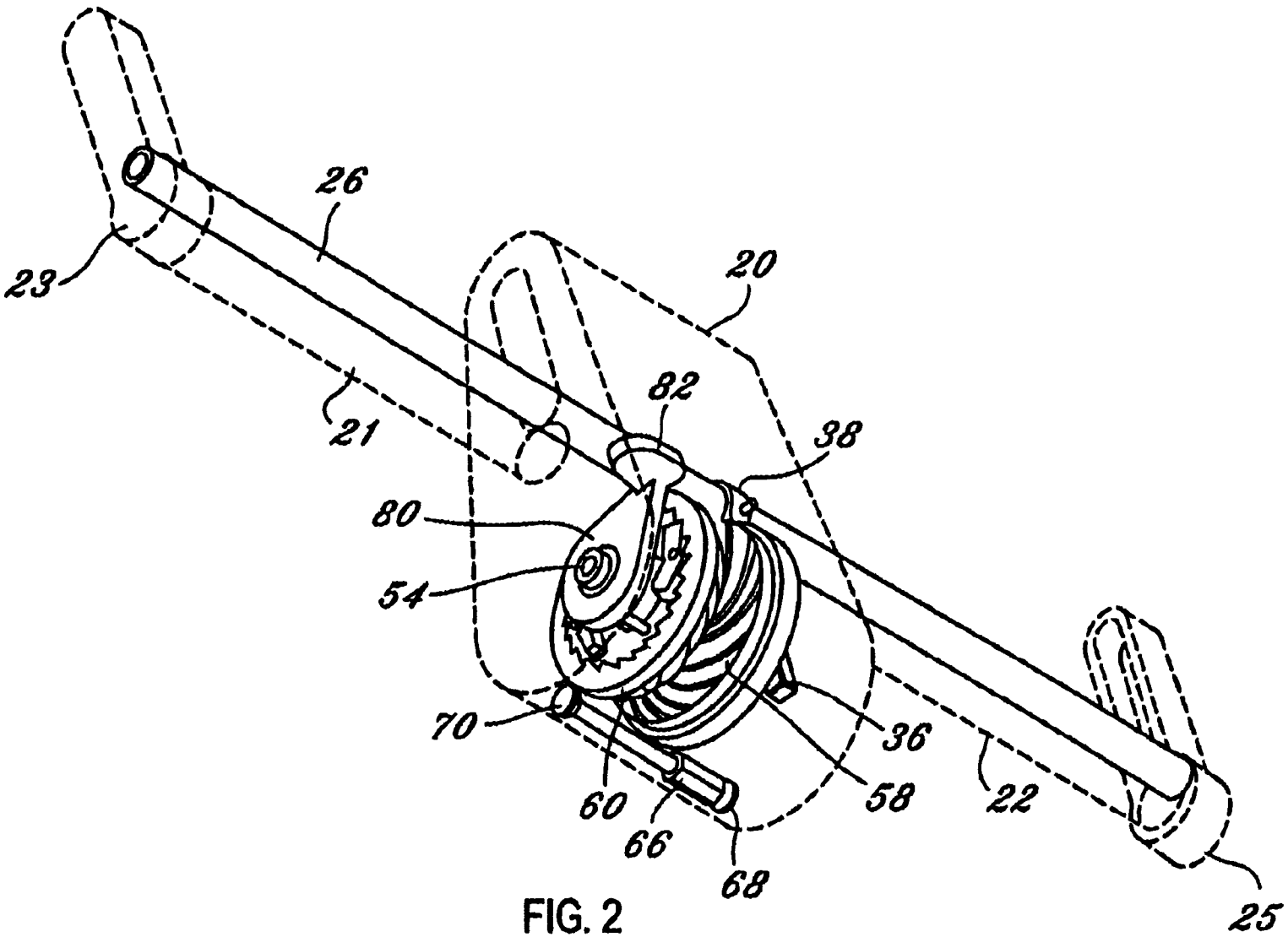
FIG. 2 is a rear perspective view of the operating mechanism shown in FIG. 1 from the opposite side.

The housing device 20 may be made of a plurality of mating parts to form the internal cavities; or it may be constructed of a pair of clamshell members which are closed around the operating mechanism for the stretching apparatus. Since the housing device 20 may be of any suitable configuration, it is shown only in dotted lines in FIGS. 1 and 2; although subsequent figures illustrate the housing device 20, or various portions of it, in solid lines. It is believed that the perspective views of FIGS. 1 and 2, however, are more clearly understood with the housing device 20 merely being indicated in dotted lines showing it in phantom. In FIGS. 1 and 2 other portions of the exercising device also are shown, at least in part, in dotted lines. These include a pair of right and left handgrips or handlebars 21 and 22, each secured at one end to the central housing device 20, each and secured at the other end in a circular aperture in a pair of guide members 23 and 25, respectively.

The guide member 23 is shown in solid lines in FIG. 1. As is apparent from an examination of FIG. 1, the guide member 23 includes a hollowed out elongated channel 24 between the enlarged end where the handle 21 is secured and its opposite end. A similar channel (not numbered) is present in the guide member 25.

Figure 3:
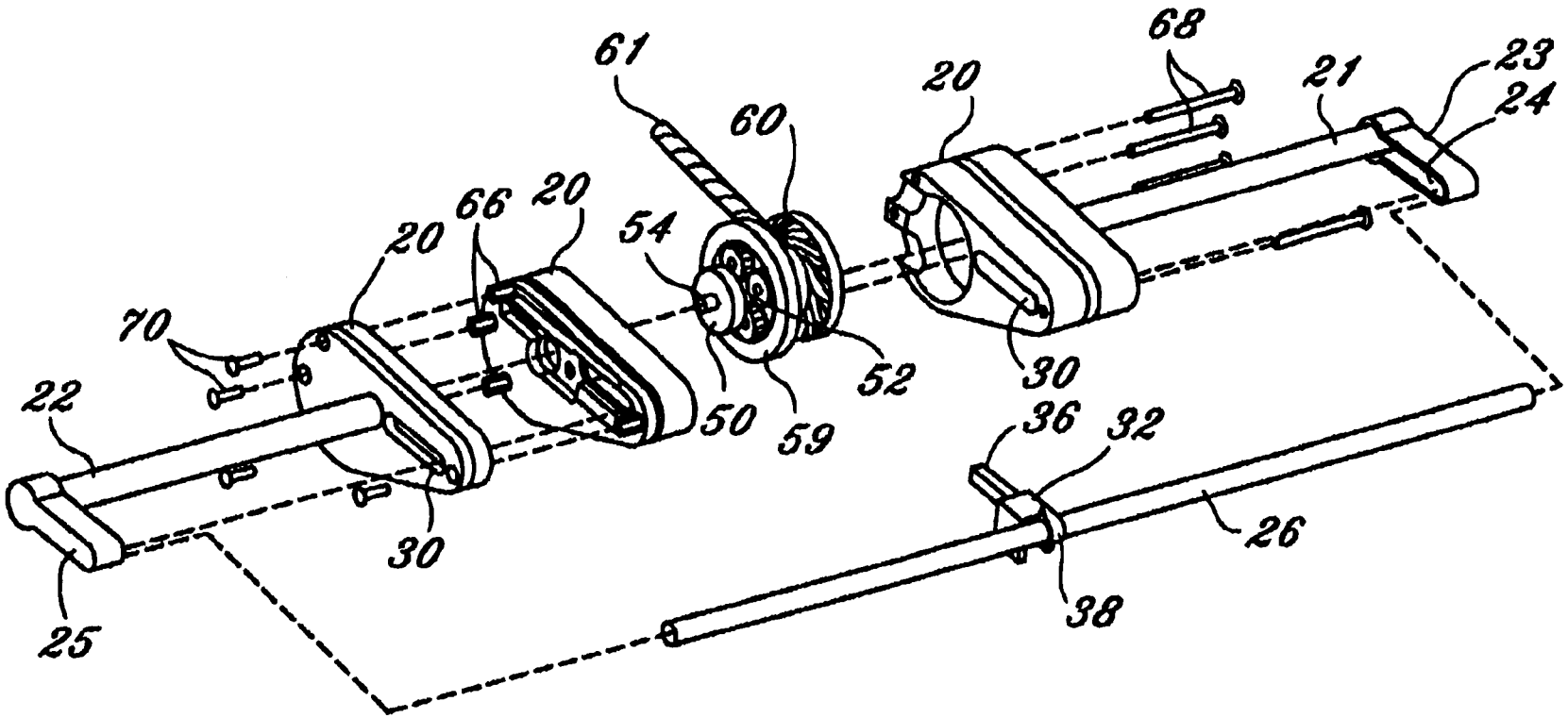
FIG. 3 is an exploded view of a portion of the operating mechanism of a preferred embodiment of the invention.

The basic user activated operating element of the exercise device comprises an elongated handle member in the form of a rod which extends from the channel 24 in the guide member 23 to the corresponding channel in the guide member 25, as shown clearly in FIGS. 1, 2 and 3. The rod 26 is designed to be engaged by the right and left thumbs of the user, with the fingers of the right and left hands engaging the handgrips 21 and 22, respectively. The operating rod 26 is spring biased away from the handgrips 21 and 22 by springs (not shown); so that in the rest position of the device, the rod 26 is located near or at the right-hand end (as shown in FIG. 1) of the channel 24 and the corresponding channel in the member 25.

The distance between the rod 26 and the handgrips 21 and 22 is relatively short, on the order of 2½" to 4". This permits reciprocal movement of the 26 rod back-and-forth, in the direction of the arrows shown in FIG. 1, in the channels in the members 23 and 25, and in a corresponding elongated channel or slot 30 through the main housing 20. The slot 30 in the main housing 20 is illustrated most clearly in FIGS. 8 through 13; although various others of the figures also show the slot 30 in its location relative to other portions of the exercise device.

In operating the exercise device, reciprocal movement of the rod 26 back-and-forth in the channels, such at the channel 24, is used to push and pull an elongated rack gear 36 mounted in a bracket 32, which is attached to the housing 20. The rack gear 36 moves back-and-forth with its power or operating stroke occurring when it is driven from the end of the channel 24 toward the handgrips 21 and 22, as illustrated in FIG. 1. FIG. 1 shows the position of the operating rod 26 in its farthermost position of travel for an operating stroke of the device.

Figure 9:
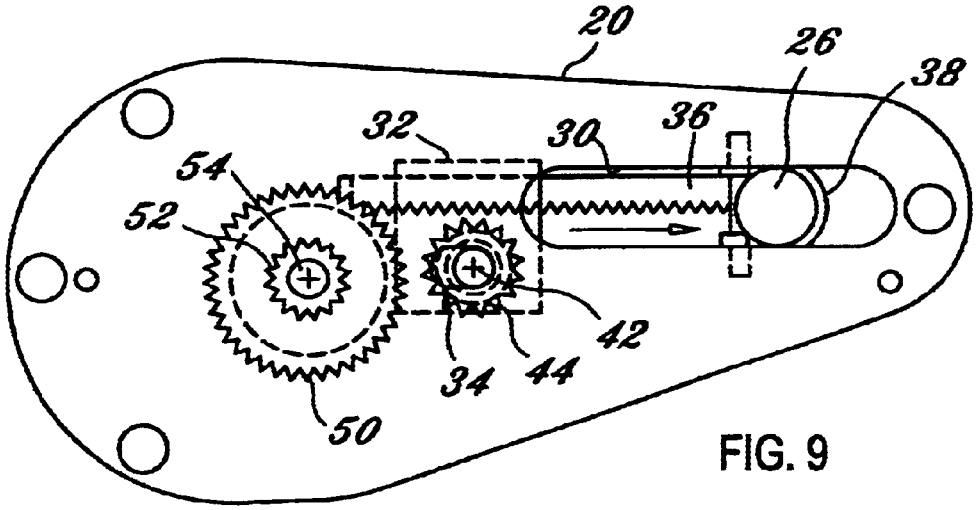
Figure 10:
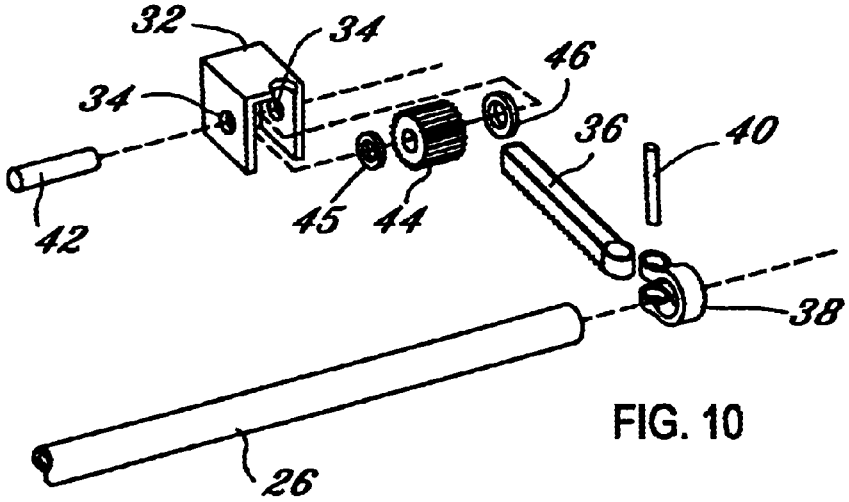
FIG. 10 is an exploded view of a portion of the mechanism of a preferred embodiment of the invention.
Figure 11:
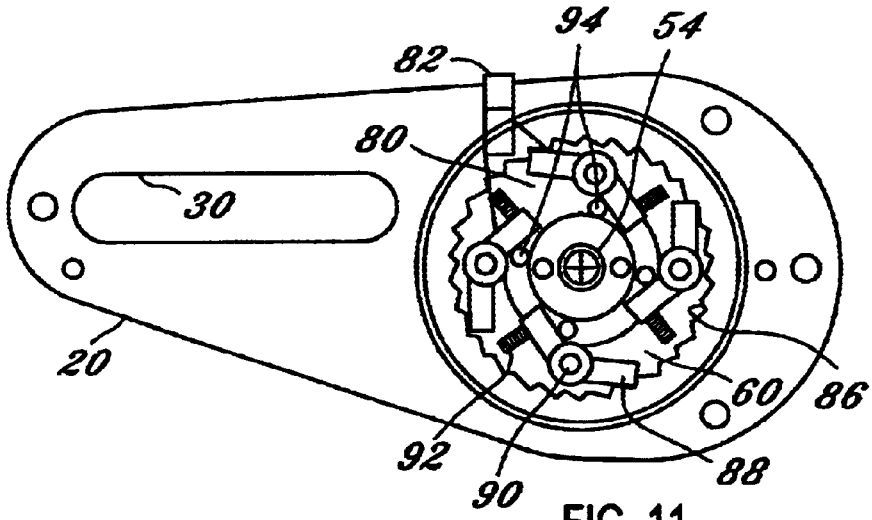
FIG. 11 is a cut-away side view of a portion of the operating mechanism of a preferred embodiment of the invention.

As shown in FIG. 1 and in the exploded view of FIG. 10, the rack gear 36 is attached at one end to the center of the operating rod 26, through a bracket 38, by means of a pin or rivet which extends through a hole in the end of the rack gear 36 and corresponding upper and lower holes in the bracket 38. The rack ear 36 then rides on the top of an idler pinion gear 44, which is carried on a shaft 42 reciprocally mounted in a slot 34 in the ides of the bracket 32. The slot 34 is slightly longer than the diameter of the shaft 42 to permit the idler pinion gear 44 to move back-and-forth in the slot 34 as the rack gear 36 moves back-and forth under the control of the movement of the operating rod 26. The location of various ones of these parts are shown in FIGS. 1, 8, 9 and 10.

Figure 8:
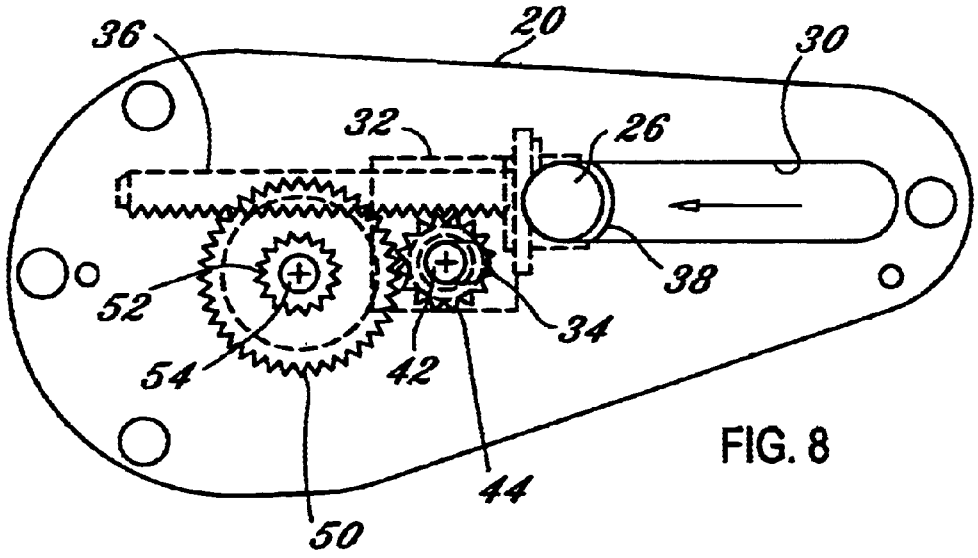
FIGS. 8 and 9 are side views of a portion of the mechanism of a preferred embodiment of the invention illustrating features of its operation.

FIG. 8 shows the driving or operating position when the thumbs are used to squeeze the operating rod 26 forward toward the handgrips 21 and 22. When this occurs, the shaft 42 carrying the idler pinion gear 44 rolls toward the left-hand end of the slot 34 (as viewed in FIGS. 8 and 9) to cause the gear 44 to engage the outer teeth of a driver pinion gear 50, as seen most clearly in FIG. 8. Thus, as the rack 36 moves toward the left, as shown in FIG. 8, the idler pinion gear 44 rotates and engages the driver pinion gear 50 to rotate the driver pinion gear counterclockwise as viewed in FIG. 8. This occurs for each squeezing or driving stroke of the operating rod 26 in the direction of the arrow shown in FIG. 8.

When the squeezing force between the handgrips 21 and 22 and the rod 26 is released, the spring action from the return springs (not shown) pushes the operating rod 26 toward the right, as viewed in FIG. 9 and as indicated by the arrow pointing toward the right in FIG. 9. When this occurs, immediately upon the commencement of the rightward motion of the rack gear 36, the shaft 42 carrying the idler pinion gear 44 is moved toward the right in the slot 34. This moves the gear 44 out of engagement with the drive pinion 50; so that rotation of the drive pinion 50 ceases. It is apparent that continued reciprocal or back-and-forth motion of the operating rod 26 between the positions shown in FIGS. 8 and 9 causes intermittent incremental rotation of the driver pinion 50 for each full cycle of operation of the rod 26 between the position shown in FIG. 8 to the position shown in FIG. 9, and back again to the position shown in FIG. 8.

Figure 6:
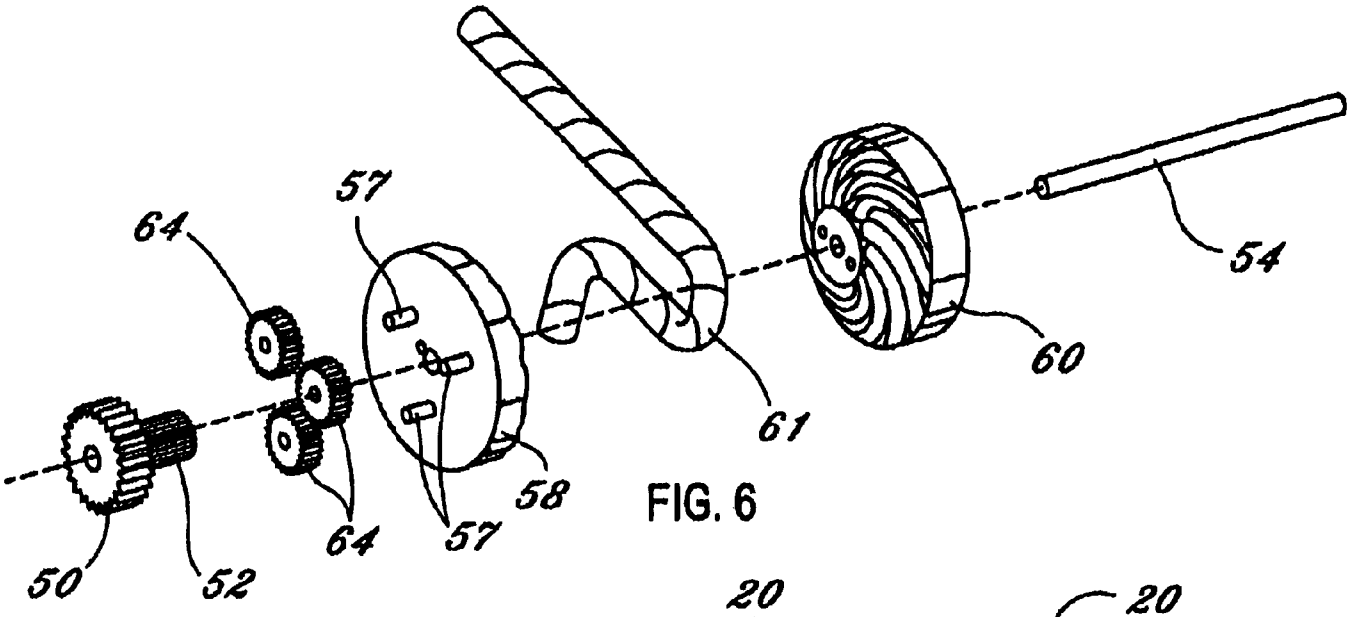
FIGS. 6 and 7 are exploded perspective views of other portions of the operating mechanism of a preferred embodiment of the invention.
Figure 7:
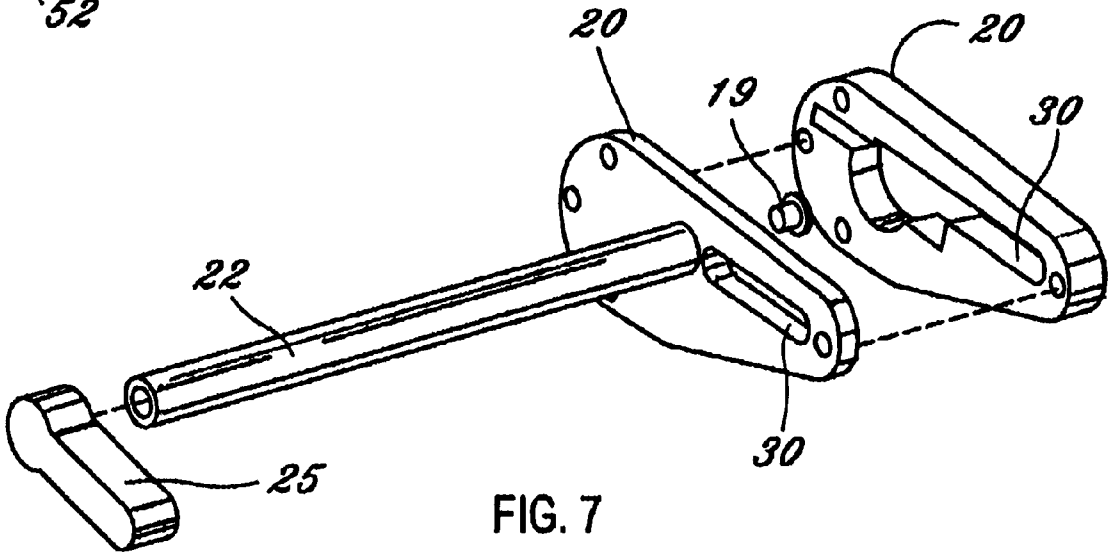

The driver pinion gear 50 includes a smaller gear portion 52 located on its right-hand end (as viewed in FIG. 6). Gears 50 and 52 are part of a gear reduction chain, the remainder of which is effected by means of a ring gear and pinion assembly in which the gear 52 acts as the driving gear for three planetary pinions 64 mounted on the right-hand side of a pulley half 58 (as shown in FIG. 1), and shown as mounted on the left-hand side of the pulley 58 in the view of FIG. 6. The planetary pinion gears 62 are mounted on respective shafts 57, which are secured to the pulley half 58 at equi-angular positions, as shown most clearly in FIGS. 6 and 11.

The ring gear portion of the gear reduction assembly comprises a ring gear 59, which is secured by any suitable means in the housing 20 against rotation. The relative position of the ring gear 59 and the planetary gears 54, along with the driver 52, is shown most clearly in FIG. 11; although FIG. 6 illustrates in exploded view the manner in which these various parts fit together. Consequently, each time a reciprocating cycle of the operating bar 26 is effected through the operating strokes described above in conjunction with FIGS. 8 and 9, the gear 52 rotates the pulley half 58 through the attached shafts 57 on the planetary gears 64 to effect stepped incremental rotation of the pulley clockwise, in the direction of the center arrows and top arrow shown in FIG. 11. This causes an incremental stepwise rotation of the right-hand pulley 58, as viewed in FIGS. 1 and 2, for each of these operating cycles.

The left-hand half 60 of the pulley assembly is secured at its center by any suitable means to the right-hand half 58, as viewed in FIGS. 1 and 2; so that the two halves rotate together. The pulleys are mounted for rotation on the common shaft 54, which is used as part of the gear assembly, as is apparent from an examination of various ones of the figures of the drawing.

On the other side of the assembly, on the reverse side of the pulley half 60, there is a circular ring ratchet gear 86 mounted for rotation with the pulley half 60. The pulley half 60, as well as the pulley half 58 and various ones of the gears which have been described previously, all rotate about a common shaft 54, as is clearly shown in FIGS. 1, 2, 3 and 8 through 13. As shown most clearly in FIG. 12, four equally spaced pawls 88 (only three of which have been shown in FIGS. 12 and 13 in order to avoid unnecessary cluttering of the drawing) normally engage the ratchet ring 86 to allow it to rotate in the direction of the arrows shown in FIG. 12 in the incremental rotations described previously in the operation of the device. Bias springs 92 cause the ends of the pawls to engage the teeth 86 to prevent rotation of the pulley 58/60 in the reverse direction (clockwise, as shown in FIG. 12) so long as the pawls 88 are allowed to ride on the ratchet teeth 86 in the configuration shown in FIG. 12.

Figure 12:
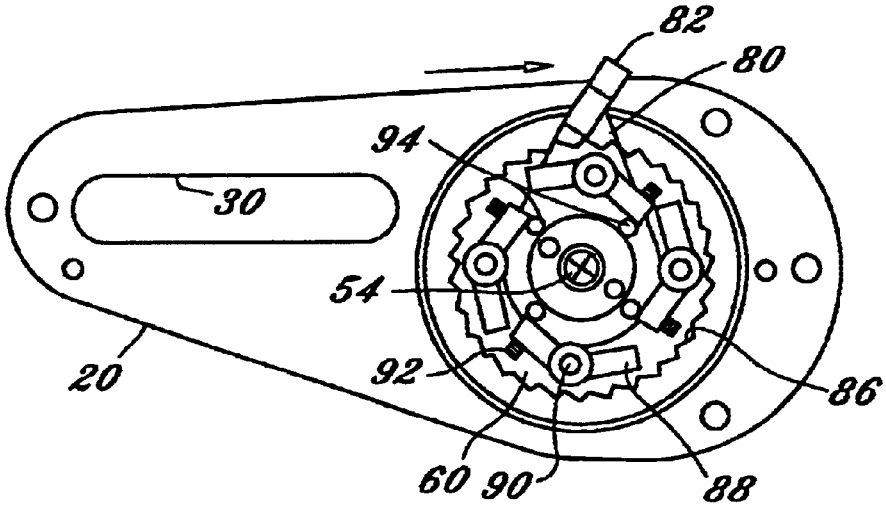
FIGS. 12 and 13 are cut-away side views of the opposite sides of the mechanism shown in FIG. 11 illustrating two different positions of operation of a preferred embodiment of the invention.
Figure 13:
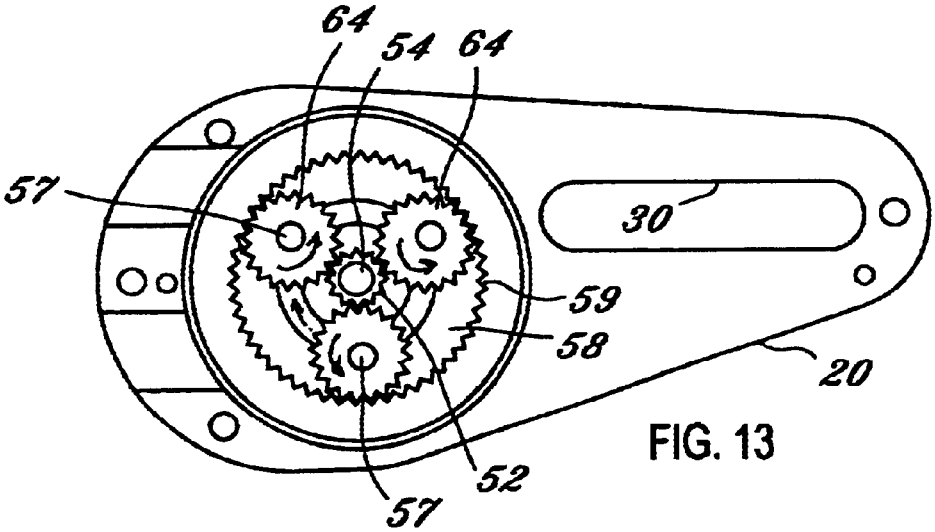

It should be noted that the pawls are mounted on shafts 90 located substantially near their centers, as is apparent from an examination of the drawings of FIGS. 12 and 13. These shafts 90 are secured to the housing 20 in the fixed position shown. The pawls 88 remain in the same position illustrated in FIGS. 12 and 13 throughout the operation of the device.

A release lever 82, which extends through an opening in the top of the housing 20, is provided to allow reverse rotation of the pulley halves 58 and 60 once a particular exercising session has been completed by a user. The release lever 82 is attached to a plate 80 designed to rotate a limited distance about the shaft 54.

The plate 80 carries four pins 94 which extend under the spring loaded ends of the pawls 88, as shown in FIG. 12. When the release lever 82 is moved rightward to the position shown in FIG. 13, the pins 94 are rotated clockwise a short distance to cam the pawls 88 out of engagement with the circular ratchet gear 86, as shown in FIG. 13. When this occurs, the pulley 58/60 no longer is held against reverse rotation. Furthermore, when this occurs with the operating rod 26 in the rightmost position as shown in FIG. 9, the reduction gear train is allowed to rotate in the opposite direction to permit withdrawal of the cable 61, rotating the pulley assembly 58/60 in the counterclockwise direction (as viewed in FIGS. 1 and 11) for purposes of release and resetting the mechanism.

Figure 5:
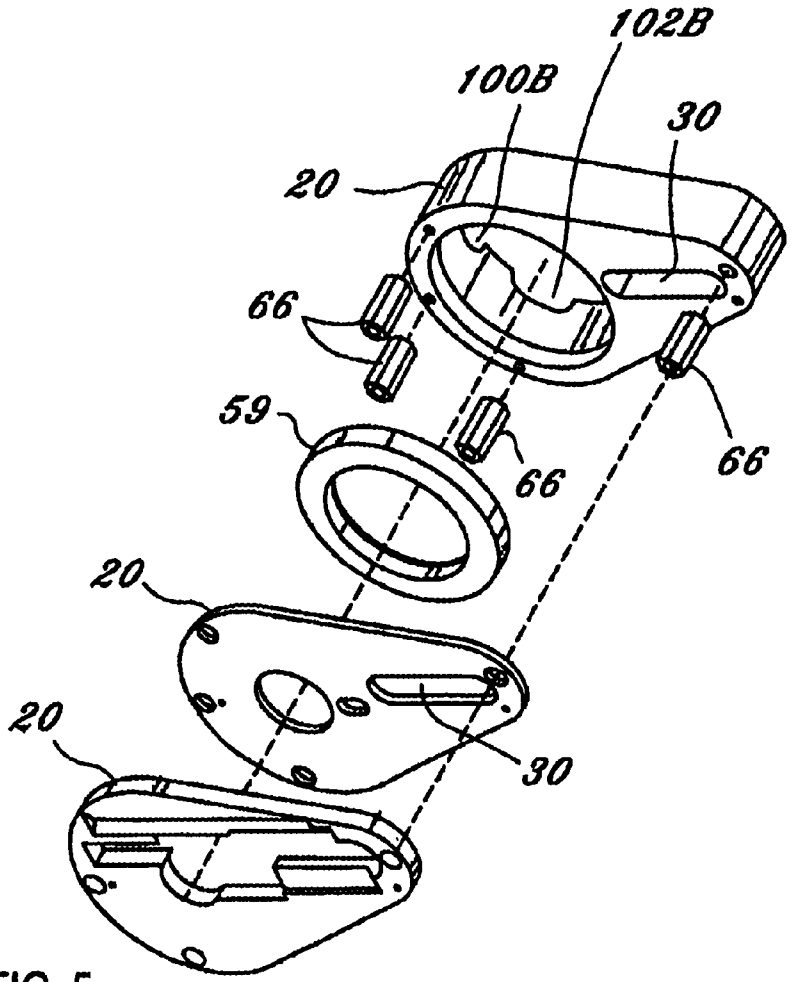
FIG. 5 is an exploded perspective view of another portion of the operating mechanism of the preferred embodiment of the invention.

As illustrated in the various exploded views of the different parts of the apparatus, the different parts of the housing 20 may be secured together by means of threaded fasteners or any other suitable type of fasteners operating in conjunction with spacers 66 and elongated bolts 68, which thread into mating internally threaded heads 70, as shown in various ones of the figures, particularly FIGS. 2, 3 and 5. FIGS. 1 and 2 show a completed assembly of one of these fastener units, several of which are used to hold the different parts of the hollow housing 20 together.

Figure 4:
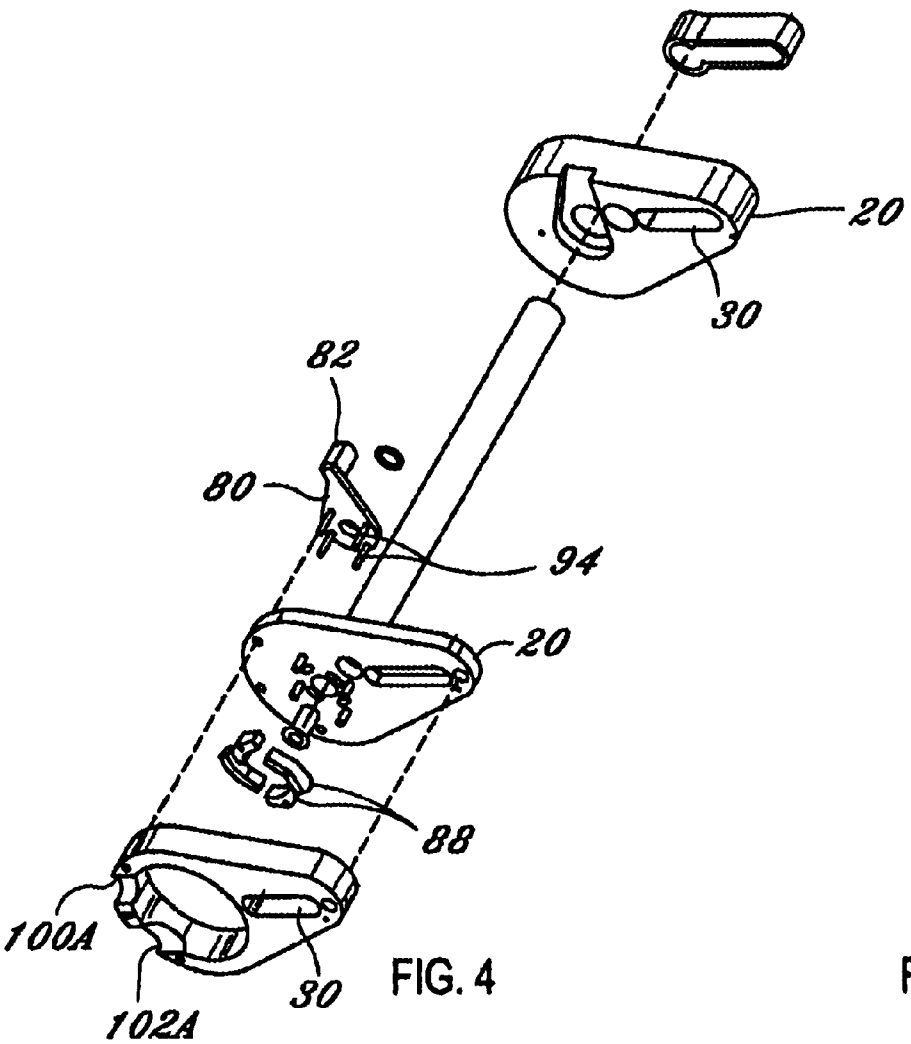
FIG. 4 is an exploded view of another portion of the operating mechanism of a preferred embodiment of the invention.

In operation of the device, the flexible cable or rope 61 is passed over the top of the pulley assembly 58/60, which have curved ribs on the facing surfaces, as most clearly shown in FIGS. 1, 2 and 6, to pull the cable or rope 61 toward the right as viewed in FIG. 3 upon each incremental operation of the device in the manner described above. The cable 61 passes through an upper opening formed by the mating faces 101A and 100B of the parts of the housing 20, as shown in FIGS. 4 and 5, to pass over the top of the pulley 58/60 and then outwardly through the lower openings 102A and 102B formed when the two halves of the unit shown in FIGS. 4 and 5 are assembled together to form the compact housing 20 illustrated in others of the drawings. A pulley device of the type formed by the pulley halves 58/60 is commonly used in marine applications, and is known as a"come-a-long". Because of the wedging action of the cable or rope 61 in the narrow portion of the pulley 58/60 near the axis at the shaft 54, the cable 61 is securely gripped and pulled toward the right, as viewed in FIGS. 3 and 6, to pull it through the pulley 58/60 and deposit the free end outwardly from the housing 20 through the slot 102A/102B.

FIGS. 14 and 18 illustrate different configurations of use for the exercise device described above in conjunction with the other FIGS. In FIG. 14, the free end of the cable or rope 61 is secured to a ring 101, which in turn is secured to a base 100 carrying a footrest portion 104 at its right-hand end, as viewed in FIG. 14. The housing 20 may be placed, in its rest or ready position, in a depression 102 for storing the device. When use of the device is to be made, the release lever 82 is operated to push it to the position shown in FIG. 13; and a desired length of cable or rope 61 is extended from the device, as illustrated in FIG. 15. When a user begins use of the device, the user 120 is in the position shown in FIG. 15. The lever 82 is released to its return position, as shown in FIG. 12, and the handgrips 21 and 22 are engaged by opposite hands of the user on either side of the central housing 20. The user 120 relaxes in the position shown in FIG. 15, with his or her feet resting against the footrest 104. Successive squeezing action to form the reciprocal movement of the operating rod 26 then is effected by the user squeezing his or thumbs toward the handgrips 21 and 22 in the sequence described above in conjunction with FIGS. 8 and 9 to incrementally draw the cable 61 through the housing 20 to pull the user 120 progressively into the positions shown in FIGS. 16 and 17.

17 illustrates a finishing position for a user who has a very flexible back and leg muscles. At any time, however, the user

120 can stop the operation of the device by ceasing to perform the sequential squeezing and releasing action of the operating rod 26 whenever the maximum stretch for that particular user 120 is reached. It should be noted that the user has absolute control over the speed at which the housing 120 is moved toward the left along the cable 61 by controlling the speed of the successive cycles of operation of the operating rod 26. Any time the user releases the operating rod 26 or holds it in the position shown in FIG. 1, rotation of the pulleys 58/60 ceases; and the position may be held.

It should be noted that the exercise device shown in the drawings, and which is described above, provides its most effective muscle stretching conditioning with users who are as relaxed as possible, and who allow the pull on the cable or rope 61 to move the housing 20 toward the left (as viewed in FIGS. 15 through 17) to accomplish all of the"work". It has been found that a very few 30 second or 60 second stretches on the same day can improve the stretching reach of most persons by 8" or more, the average shortfall for most persons to touching their toes.

FIG. 18 illustrates an alternative anchor or attachment of the fixed end or left-hand end of the cable 61. In the arrangement shown in FIG. 18, the device is attached to a bracket 112, which in turn is attached to a wall 110. An attaching ring 114, which is similar to the ring 101, is secured to the bracket 112 for holding the fixed end of the rope or cable 61 in the same manner described above for the attachment to the ring 101 in the embodiment of FIG. 14. In all other respects, the operation and use of the device is identical to that which has been described above for the embodiment shown in FIG. 14.

The foregoing description of the preferred embodiment of the invention is to be considered as illustrative and not as limiting. Various changes and modifications will occur to those skilled in the art for performing substantially the same function, in substantially the same way, to achieve substantially the same result, without departing from the true scope of the invention as defined in the appended claims.

What is claimed is:

1. An exercise device for stretching the back, neck and leg muscles of a user including in combination:

a handle body, having a handle member designed to be grasped by the hands of a user;

a fixed position member;

a flexible cable with first and second ends, secured at the first end to the fixed position member and engaged by a rotatable member in the handle body;

a pawl and ratchet mechanism in the handle body for rotating the rotatable member to draw the flexible cable member into the handle body; and a reciprocating lever member coupled with the pawl and ratchet mechanism and operated by a user reciprocating the handle member relative to the handle body to effect incremental stepwise rotation of the rotatable member through the pawl and ratchet mechanism.

2. The exercise device according to claim 1 wherein the flexible cable is engaged intermediate the first and second ends thereof by the rotatable member in the handle body.

3. The exercise device according to claim 2 wherein the handle member comprises an elongated bar mounted for linear reciprocating motion in the handle body and is coupled with the reciprocating lever member to move the reciprocating lever member back-and-forth as the elongated bar is moved back-and-forth in the handle device.

4. The exercise device according to claim 3 wherein the reciprocating lever member translates linear motion to rotational motion for effecting the incremental stepwise rotation of the rotatable member.

5. The exercise device according to claim 4 wherein the reciprocating lever member is a rack-and-pinion drive mechanism.

6. The exercise device according to claim 5 where the rack-and-pinion reciprocating lever member includes a driver pinion, an idler pinion and a rack, with the idler pinion mounted for movement into and out of engagement with the driver pinion and the rack mounted for continuous engagement with the idler pinion, such that the idler pinion is moved by the rack into engagement with the driver pinion when the rack is moved in a first direction and is moved out of engagement with the driver pinion when the rack is moved in a second opposite direction by a user reciprocating the handle member.

7. The exercise device according to claim 6 further including a manually operated release mechanism for releasing the pawl and ratchet mechanism to permit the cable to be withdrawn from the handle body.

8. The exercise device according to claim 7 wherein the fixed position member includes a footrest portion for abutting the feet of a user of the exercise device.

9. The exercise device according to claim 1 wherein the reciprocating lever member translates linear motion to rotational motion for effecting the incremental stepwise rotation of the rotatable member.

10. The exercise device according to claim 9 wherein the reciprocating lever member is a rack-and-pinion drive mechanism.

11. The exercise device according to claim 10 where the rack-and-pinion reciprocating lever member includes a driver pinion, an idler pinion and a rack, with the idler pinion mounted for movement into and out of engagement with the driver pinion and the rack mounted for continuous engagement with the idler pinion, such that the idler pinion is moved by the rack into engagement with the driver pinion when the rack is moved in a first direction and is moved out of engagement with the driver pinion when the rack is moved in a second opposite direction by a user reciprocating the handle member.

12. The exercise device according to claim 11 further including a manually operated release mechanism for releasing the pawl and ratchet mechanism to permit the cable to be withdrawn from the handle body.

13. The exercise device according to claim 1 wherein the handle member comprises an elongated bar mounted for linear reciprocating motion in the handle body and is coupled with the reciprocating lever member to move the reciprocating lever member back-and-forth as the elongated bar is moved back-and-forth in the handle device.

14. The exercise device according to claim 1 wherein the fixed position member includes a footrest portion for abutting the feet of a user of the exercise device.

15. The exercise device according to claim 1 further including a manually operated release mechanism for releasing the pawl and ratchet mechanism to permit the cable to be withdrawn from the handle body.

16. The exercise device according to claim 1 wherein the reciprocating lever member is a rack-and-pinion drive mechanism.

17. The exercise device according to claim 16 where the rack-and-pinion reciprocating lever member includes a driver pinion, an idler pinion and a rack, with the idler pinion mounted for movement into and out of engagement with the driver pinion and the rack mounted for continuous engagement with the idler pinion, such that the idler pinion is moved by the rack into engagement with the driver pinion when the rack is moved in a first direction and is moved out of engagement with the driver pinion when the rack is moved in a second opposite direction by a user reciprocating the handle member.

* * * * *